US011738829B2

(12) United States Patent
Kim et al.

(10) Patent No.: US 11,738,829 B2
(45) Date of Patent: Aug. 29, 2023

(54) OFFSHORE FACILITY, FLOATING CRUDE OIL PRODUCTION FACILITY AND METHOD FOR GENERATING LIQUEFIED NATURAL GAS

(71) Applicant: SAMSUNG HEAVY IND. CO., LTD, Gyeonggi-do (KR)

(72) Inventors: Munsung Kim, Gyeongsangnam-do (KR); Xuan-Chi Nguyen, Gyeongsangnam-do (KR); Mungyu Kim, Gyeongsangnam-do (KR); Jinki Kim, Gyeongsangnam-do (KR); Howard Marlin Newman, Gyeongsangnam-do (KR); Hoyoung Cho, Gyeongsangnam-do (KR); Cornelis Teunis De Regt, Gyeongsangnam-do (KR); Komla Toltoga Miheaye, Gyeongsangnam-do (KR)

(73) Assignee: SAMSUNG HEAVY IND. CO., LTD, Gyeonggi-Do (KR)

( * ) Notice: Subject to any disclaimer, the term of this patent is extended or adjusted under 35 U.S.C. 154(b) by 1286 days.

(21) Appl. No.: 16/305,199

(22) PCT Filed: Jan. 9, 2017

(86) PCT No.: PCT/KR2017/000271
§ 371 (c)(1),
(2) Date: Nov. 28, 2018

(87) PCT Pub. No.: WO2017/209368
PCT Pub. Date: Dec. 7, 2017

(65) Prior Publication Data

US 2020/0317305 A1 Oct. 8, 2020

(30) Foreign Application Priority Data

Jun. 1, 2016 (KR) ..... 10-2016-0068127

(51) Int. Cl.
*B63B 35/44* (2006.01)
*B63B 21/50* (2006.01)
(Continued)

(52) U.S. Cl.
CPC ..... *B63B 21/50* (2013.01); *B63B 35/44* (2013.01); *F25B 41/20* (2021.01); *F25B 41/24* (2021.01);
(Continued)

(58) Field of Classification Search
CPC ..... F25J 1/0022; F25J 1/0259; F25J 1/0278; F25J 1/0204; F25J 1/0072; F25J 1/0232;
(Continued)

(56) References Cited

U.S. PATENT DOCUMENTS 6,094,937 A 8/2000 Paurola et al.
6,250,244 B1 6/2001 Dubar et al.
(Continued)

FOREIGN PATENT DOCUMENTS

KR 101076271 B1 10/2011
KR 20140118269 A 10/2014
(Continued)

OTHER PUBLICATIONS

International Search Report issued in corresponding PCT Application No. PCT/2017/000271 dated Apr. 14, 2017.
(Continued)

*Primary Examiner* — Frantz F Jules
*Assistant Examiner* — Webeshet Mengesha
(74) *Attorney, Agent, or Firm* — Carter, DeLuca & Farrell LLP

(57) ABSTRACT

An offshore facility for producing a liquefied natural gas using an associated gas includes a crude oil production offshore facility having a crude oil processing device for refining crude oil collected from a subsea well to produce
(Continued)

oil, and a gas reinjection device for compressing an associated gas separated in crude oil refining process to be reinjected into a reservoir, and a liquefied natural gas production offshore facility supplied with a feed gas including at least a part of the associated gas from the crude oil production offshore facility, and processing and liquefying the feed gas to generate a liquefied natural gas. The crude oil production offshore facility includes a feed gas supply unit for recovering a back-flow gas formed when an injection gas compressed by the gas reinjection device flows backward and generating the feed gas by using the back-flow gas.

8 Claims, 10 Drawing Sheets

(51) Int. Cl.

| | |
|---|---|
| ***F25J 1/00*** | (2006.01) |
| ***F25J 1/02*** | (2006.01) |
| ***F25B 41/20*** | (2021.01) |
| ***F25B 41/24*** | (2021.01) |
| *B63B 25/14* | (2006.01) |

(52) U.S. Cl.
CPC ..... *F25J 1/0022* (2013.01); *F25J 1/0259* (2013.01); *F25J 1/0278* (2013.01); *B63B 25/14* (2013.01); *B63B 2035/448* (2013.01); *B63B 2035/4473* (2013.01); *F25J 2230/30* (2013.01)

(58) Field of Classification Search
CPC ..... F25J 1/0052; F25J 1/0037; F25J 1/023; B63B 35/16; B63B 35/44; B63B 2035/4473; B63B 2035/448; E21B 43/12; E21B 43/34; E21B 43/36; E21B 43/38; E21B 43/40
See application file for complete search history.

(56) References Cited

U.S. PATENT DOCUMENTS

| | | | | |
|---|---|---|---|---|
| 2006/0213223 | A1* | 9/2006 | Wilding | F28D 7/0066 62/613 |
| 2012/0024391 | A1* | 2/2012 | Wille | E21B 41/0007 166/345 |
| 2012/0047942 | A1* | 3/2012 | Kolodziej | F25J 3/0242 62/51.1 |
| 2015/0075216 | A1 | 3/2015 | Van Wijngaarden et al. | |
| 2017/0335213 | A1* | 11/2017 | Jakobsson | B01D 53/22 |

FOREIGN PATENT DOCUMENTS

| | | | | |
|---|---|---|---|---|
| KR | 20150061186 | A | 6/2015 | |
| KR | 20150111496 | A | 10/2015 | |
| KR | 101654220 | B1 | 9/2016 | |
| WO | 2010117265 | A2 | 10/2010 | |
| WO | WO-2015133806 | A1 * | 9/2015 | B63H 21/38 |

OTHER PUBLICATIONS

European Search Report issued in corresponding EP Application No. 17806861.5 dated Jan. 7, 2020.

* cited by examiner

OFFSHORE FACILITY, FLOATING CRUDE OIL PRODUCTION FACILITY AND METHOD FOR GENERATING LIQUEFIED NATURAL GAS

CROSS REFERENCE TO RELATED APPLICATIONS

This application is a national stage of International Application No. PCT/KR2017/000271, filed on Jan. 9, 2017, which claims the benefit of and priority to Korean Patent Application No. 10-2016-0068127, filed on Jun. 1, 2016, the entire contents of each of which are hereby incorporated by reference in their entirety.

TECHNICAL FIELD

The present invention disclosed herein relates to an offshore facility, a floating crude oil production facility, and a method for generating a liquefied natural gas, and more particularly, to an offshore facility for generating a liquefied natural gas using an associated gas, a floating crude oil production facility thereof, and a method for generating a liquefied natural gas using the same.

BACKGROUND

A floating crude oil production storage offloading facility is an offshore complex structure which extracts and refines crude oil from subsea oil fields, produces and stores refined products, and transfer the refined products to other ships. In an oil refining process, crude oil is separated into oil and an associated gas. In most crude oil fields, the associated gas is burnt, or is reinjected into another empty reservoir completely developed and discarded. When the associated gas separated from the crude oil in an offshore facility is discharged at a pressure higher than a certain level which is required to maintain the pressure of a reservoir, the associated gas will be discarded to the seabed by the amount above a corresponding certain level. On the other hand, the cost for reinjecting the gas is increased more than necessary.

SUMMARY

Technical Problem

The present invention provides an offshore facility for reinjecting a gas (injection gas) obtained by compressing an associated gas into a reservoir, wherein the facility is configured to recover a back-flow gas which is a backwardly flowing overflow gas of an injection gas injected to the reservoir, and generate a liquefied natural gas by using the recovered back-flow gas. Also, the present invention provides a floating crude oil production facility thereof, and a method for generating a liquefied natural gas using the same.

The problems to be solved by the present invention are not limited to the above-described problems. Other technical subjects not mentioned will be clearly understood to those skilled in the art from following description.

Technical Solution

Embodiments of the present invention provide an offshore facility including: a crude oil production offshore facility having a crude oil processing device for refining crude oil collected from a subsea well to produce oil, and a gas reinjection device for compressing an associated gas separated in the process of refining crude oil, and reinject the compressed gas into a reservoir; and a liquefied natural gas production offshore facility supplied with a feed gas including at least a part of the associated gas from the crude oil production offshore facility, and processing and liquefying the feed gas to generate a liquefied natural gas, The crude oil production offshore facility may be provided with a feed gas supply unit for generating the feed gas by recovering a back-flow gas formed when an injection gas compressed by the gas reinjection device flows backward, and using the back-flow gas.

The feed gas supply unit may include a compression device for generating a first feed gas by compressing the associated gas such that the associated gas has a first target pressure, wherein the gas reinjection device may include a compressor for generating the injection gas by compressing the associated gas compressed by the compression device such that the associated gas has a second target pressure higher than the first target pressure, wherein the feed gas may include at least one of the first feed gas, a second feed gas decompressed from the back-flow gas, and a third feed gas decompressed from the injection gas.

The gas reinjection device may further include an injection line for reinjecting the injection gas into the reservoir, and wherein the feed gas supply unit may further include: a feed gas supply line for transferring the liquefied natural gas to the liquefied natural gas production offshore facility; a back-flow line branched from the injection line and joined to the feed gas supply line and recovering the back-flow gas to the crude oil production offshore facility; and a first decompression unit for decompressing the back-flow gas to generate the second feed gas.

The gas reinjection device may further include a valve unit installed on the injection line and regulating the injection of the injection gas, wherein the feed gas supply unit may further include: an injection gas recovery line branched from the injection line between the compressor and the valve unit and jointed to the feed gas supply line; and a second decompression unit installed on the injection gas recovery line and decompressing the injection gas to generate the third feed gas.

The first decompression unit or the second decompression unit may include a choke valve.

The feed gas supply unit further includes a regulation valve installed on the feed gas supply line and regulating the supply of the first feed gas, and the back-flow line and the injection gas recovery line may be respectively joined to a downstream side of the regulation valve on the basis of a feeding direction of the feed gas.

The crude oil production offshore facility may further include a control unit for controlling at least one of the regulation valve, the valve unit, the first decompression unit, and the second decompression unit.

The control unit, when the pressure of the first feed gas satisfies a set pressure range, performs control such that the regulation valve may be opened and the first feed gas may be supplied to the liquefied natural gas production offshore facility, and the supplies of the second feed gas and the third feed gas may be shut off; and when the pressure of the first feed gas does not satisfy the set pressure range, the control unit performs control such that at least one of the first decompression unit and the second decompression unit may be operated to supply at least one of the second feed gas and the third feed gas to the liquefied natural gas production offshore facility, and the regulation valve may be shut off.

The liquefied natural gas production offshore facility may include: a turret unit supplied with the feed gas; a liquefied natural gas generation unit for processing and liquefying the feed gas to generate the liquefied natural gas; and a plurality of storage tanks provided in one row along the longitudinal direction of hull and storing the liquefied natural gas.

The liquefied natural gas generation unit may include: an injection unit including a heating unit for heating the feed gas to a set temperature; an acid gas removal unit for removing an acid gas from the heated feed gas provided from the injection unit; a dehydration and mercury removal unit for removing moisture and mercury from the feed gas from which the acid gas has been removed; and a liquefaction unit for generating the liquefied natural gas by liquefying the feed gas from which the moisture and mercury are removed, wherein the liquefied natural gas production offshore facility may further include: a heavy hydrocarbon removal unit for removing heavy hydrocarbons from fluid generated by the liquefaction unit; and a condensate transfer line for transferring condensate including the heavy hydrocarbons for the processing and stabilization of the heavy hydrocarbons to the crude oil production offshore facility.

Other embodiments of the present invention provide a floating crude oil production facility including: a turret device for extracting crude oil from a subsea well; a crude oil processing device for refining the crude oil to generate oil; an oil storage device for storing the oil produced by the crude oil processing device; a gas reinjection device for compressing an associated gas separated in the crude oil refining process of the crude oil processing device to generate an injection gas, and reinjecting the injection gas into a reservoir; and a feed gas supply unit for recovering a back-flow gas formed when the injection gas flows backward, generating a feed gas by using the back-flow gas, and supplying the feed gas to a liquefied natural gas generation unit side.

The feed gas supply unit may include: a compression device for compressing the associated gas to generate a first feed gas; and a feed gas supply line for transferring the first feed gas to the liquefied natural gas generation unit side, the gas reinjection device may include: a compressor for compressing the associated gas compressed by the compression device to generate the injection gas, and the feed gas may include at least one of the first feed gas, the second feed gas decompressed from the back-flow gas, and the third feed gas decompressed from the injection gas.

The gas reinjection device may further include: an injection line for reinjecting the injection gas into the reservoir; and a valve unit installed on the injection line, and regulating the injection of the injection gas, wherein the feed gas supply unit may further include: a regulation valve installed on the feed gas supply line and regulating the supply of the first feed gas; a back-flow line branched from the injection line and recovering the back-flow gas to the feed gas supply line; a first decompression unit installed on the back-flow line and decompressing the back-flow to generate the second feed gas; an injection gas recovery line branched from the injection line between the compressor and the valve unit and recovering the injection gas to the feed gas supply line; and a second decompression unit installed on the injection gas recovery line and decompressing the injection gas to generate the third feed gas.

Still other embodiments of the present invention provide a method for generating a liquefied natural gas, the method including: collecting crude oil from a subsea well by a crude oil production offshore facility and refining to separate the collected crude oil into oil and an associated gas; generating a first feed gas by compressing the associated gas such that the associated gas has a first target pressure, and providing the first feed gas to a feed gas supply line side; generating an injection gas by compressing the first feed gas such that the associated gas has a second target pressure, and reinjecting the injection gas to a reservoir; decompressing a back-flow gas formed when the injection gas flows backward to generate a second feed gas, and recovering the second feed gas to the feed gas supply line side; decompressing the injection gas to generate a third feed gas, and recovering the third feed gas to the feed gas supply line side; supplying a feed gas including at least one of the first feed gas, the second feed gas, and the third feed gas to the feed gas supply line; and processing and liquefying the feed gas supplied through the feed gas supply line to generate a liquefied natural gas.

The supplying the feed gas to the feed gas supply line, may include: when the pressure of the first feed gas satisfies a set pressure range, supplying the first feed gas to the feed gas supply line, and shutting off the second feed gas and the third feed gas such that the second feed gas and the third feed gas are not supplied to the feed gas supply line; when the pressure of the first feed gas does not satisfy the set pressure range, supplying at least one of the second feed gas and the third feed gas to the feed gas supply line, and shutting off the first feed gas such that the first feed gas is not supplied to the feed gas supply line.

Advantageous Effects

According to an embodiment of present invention, in an offshore facility for reinjecting a gas obtained by compressing an associated gas (injection gas) into a reservoir, the facility is configured to recover a back-flow gas which is a backwardly flowing overflow gas of an injection gas injected to the reservoir and produce a liquefied natural gas by using the recovered back-flow gas, so that the productivity of the liquefied natural gas using the associated gas may be improved.

The effect of the present invention is not limited to the above-described effects. Effects not described may be clearly understood to those skilled in the art to which the present invention belongs from this specification and the attached drawings.

DETAILED DESCRIPTION

Figure 1:
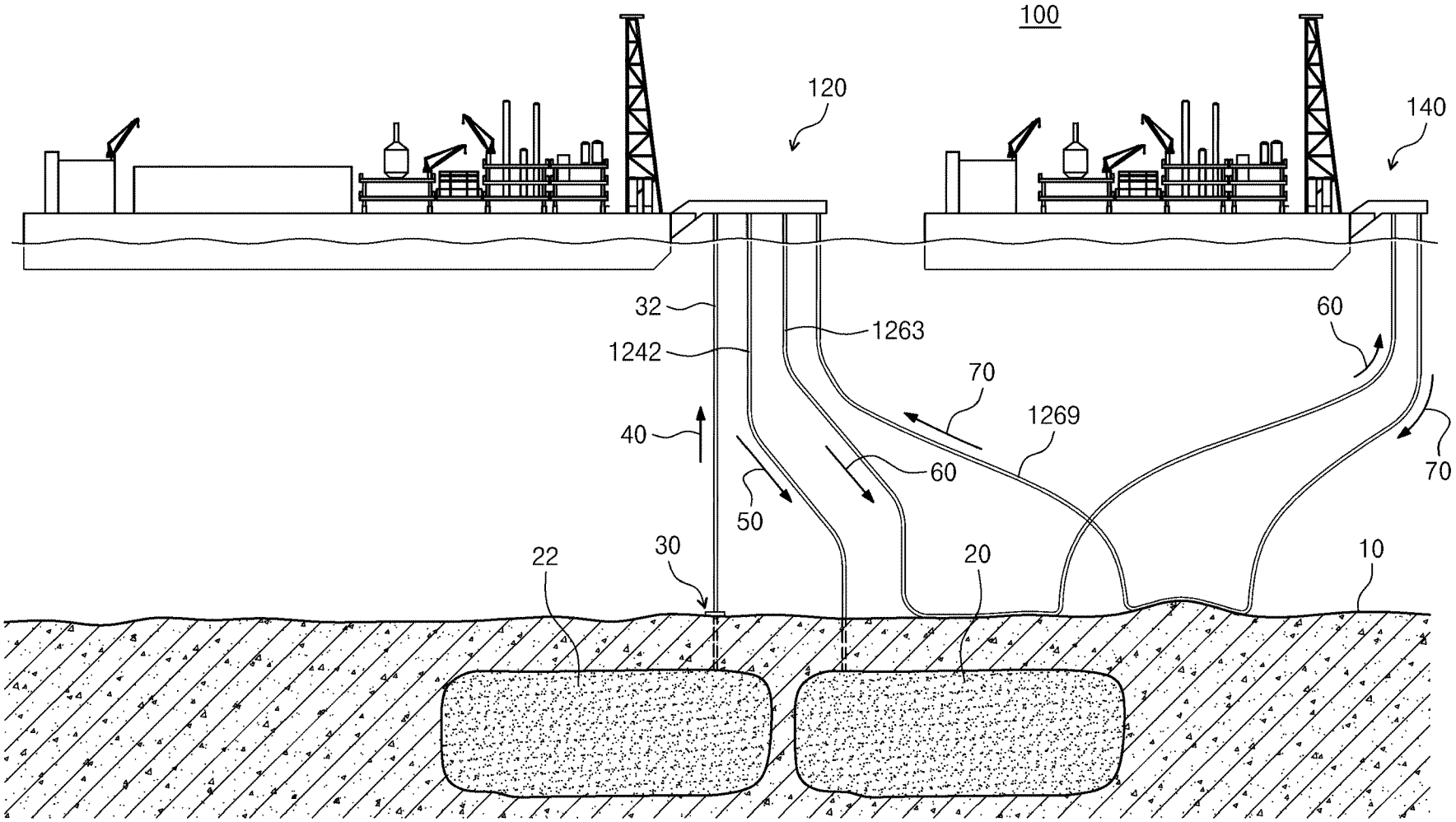
FIG. 1 is a side view schematically illustrating an offshore facility 100 according to an embodiment of the present invention.

Other advantages and features of the present invention, as well as methods of achieving them, will be apparent from and elucidated with reference to the embodiments described hereinafter with reference to the accompanying drawings. However, the present invention is not limited to the embodiments disclosed below, and the present invention is only defined by the scope of the claims. Although not defined, all terms (including technical or scientific terms) used herein have the same meaning as commonly accepted by the generic art in the prior art to which this invention belongs. The general description of known configurations may be omitted so as not to obscure the gist of the present invention. In the drawings of the present invention, the same reference numerals are used as many as possible for the same or corresponding configurations. To facilitate understanding of the present invention, some configurations in the figures may be shown somewhat exaggerated or reduced.

The terminology used herein is for the purpose of describing particular embodiments only and is not intended to be limiting of the invention. The singular forms "a", "an", and "the" include plural referents unless the context clearly dictates otherwise. In the present application, the terms such as "comprising", "having", or "comprising", when used in this specification, designate the presence of stated features, integers, steps, operations, elements, parts, or combinations thereof, whether or not explicitly described in connection with the drawings or description.

Figure 2:
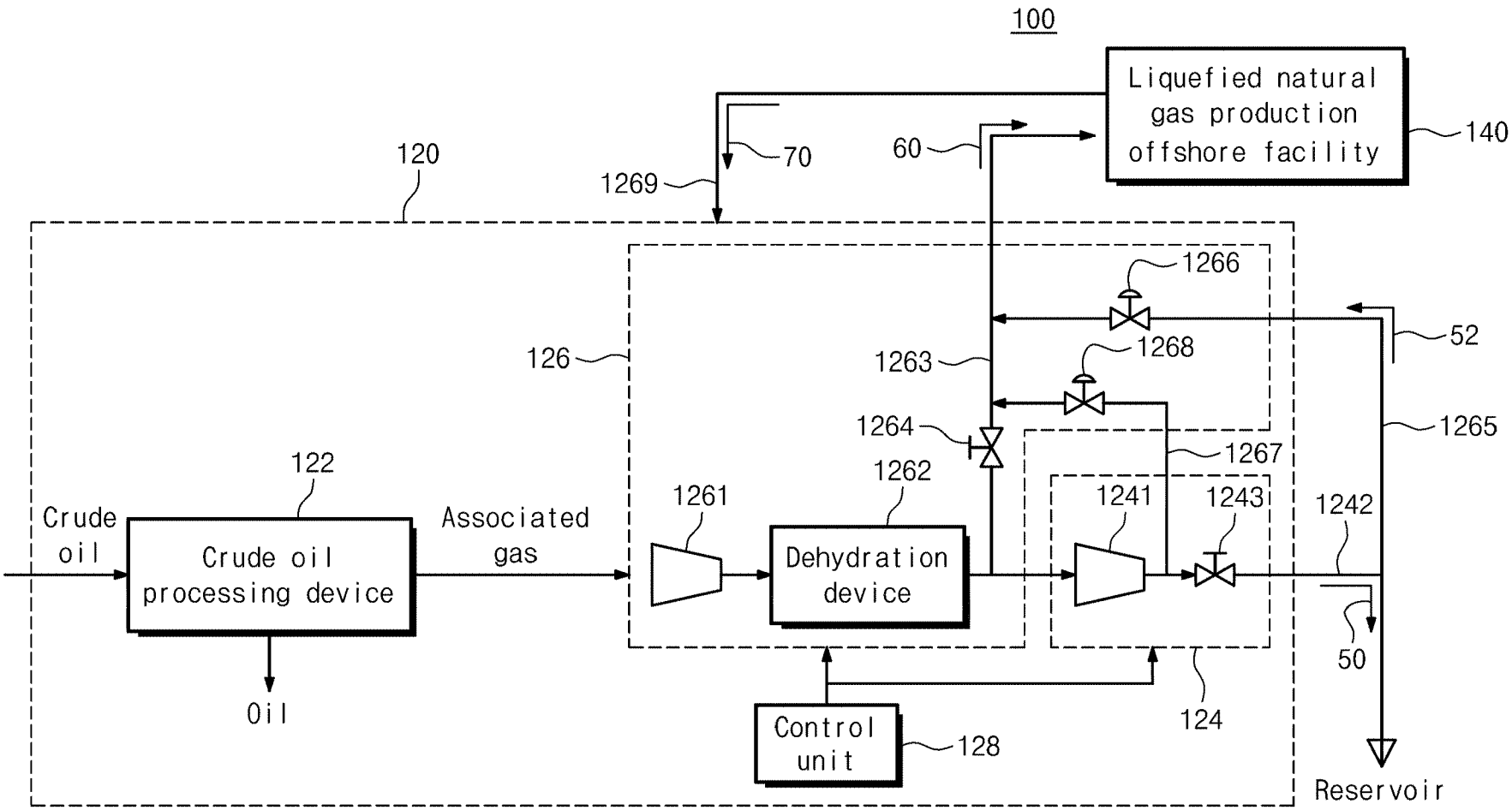
FIG. 2 is a block diagram of a crude oil production offshore facility constituting an offshore facility 100 according to an embodiment of the present invention.

FIG. 1 is a side view schematically illustrating an offshore facility 100 according to an embodiment of the present invention. FIG. 2 is a block diagram of a crude oil production offshore facility 120 constituting an offshore facility 100 according to an embodiment of the present invention. Referring to FIGS. 1 and 2, the offshore facility 100 includes a crude oil production offshore facility 120 and a liquefied natural gas production offshore facility 140.

The crude oil production offshore facility 120 corrects crude oil 40 including a hydrocarbon mixture from a well 30 of the seabed 10 through a riser 32. The crude oil production offshore facility 120 may include a turret device, a crude oil processing device 122, a gas reinjection device 124, a feed gas supply unit 126, and a control unit 128.

The turret device may be provided such that crude oil is extracted from a reservoir 22 in the subsea well through the riser 32, an associated gas is reinjected into an empty reservoir 20 completely developed and discarded, and a feed gas 60 generated using the associated gas is transferred to a liquefied natural gas production offshore facility 140 side. In an example in FIG. 1, the associated gas is reinjected into the reservoir 20 completely developed and discarded, but is not limited as illustrated, and it is also possible to reinject the associated gas into the reservoir 22 which is producing an associated gas. The turret device may be operated by mounted on a vertical opening portion or a moon pool provided on the bow side of a hull.

The crude oil processing device 122 refines crude oil to produce oil, and in this process, the oil and the associated gas are separated. The associated gas separated from the crude oil processing device 122 is provided to the gas reinjection device 124 through the feed gas supply unit 126.

The feed gas supply unit 126 is configured such that an injection gas compressed by the gas reinjection device 124 recovers a back-flow gas flowed backward, and uses the back-flow gas to generate a feed gas (second feed gas).

In one embodiment, the feed gas supply unit 126 may include a compression device 1261, a dehydration device 1262, a feed gas supply line 1263, a regulation valve 1264, a back-flow line 1265, a first decompression unit 1266, an injection gas recovery line 1267, and a second decompression unit 1268.

The compression device 1261 may generate a first feed gas by compressing the associated gas such that the associated gas has a first target pressure. In one embodiment, the first target pressure may be 30-200 bar (e.g., 70 bar). The first target pressure may be set to a pressure at which the production efficiency of a liquefied natural gas (LNG) by the feed gas becomes maximum.

In order to prevent failure of various facilities and clogging of pipelines by reducing the occurrence of hydrates, the dehydration device 1262 may remove moisture from the associated gas compressed by the compression device 1261 using a molecular filter or the like. The associated gas dehydrated by the dehydration device 1262 is provided to the feed gas supply line 1263 and the gas reinjection device 124. The first feed gas refers to the associated gas flowing into the feed gas supply line 1263 from among the associated gas compressed by the compression device 1261.

The feed gas supply line 1263 may be provided such that it is connected between the turret units of the crude oil production offshore facility 120 and the liquefied natural gas production offshore facility 140 to transfer the feed gas 60 to the liquefied natural gas production offshore facility 140.

In the example illustrated in FIG. 1, the feed gas supply line 1263 is composed of a subsea pipe, a riser, or the like via the seabed 10 and is connected between the crude oil production offshore facility 120 and the liquefied natural gas production offshore facility 140, but may be provided such that it is connected between the crude oil production offshore facility 120 and the liquefied natural gas production offshore facility 140 without passing through the seabed 10.

The regulation valve 1264 may be installed on the feed gas supply line 1263 and regulate the supply of the first feed gas provided via the compression device 1261 the dehydration device 1262. Upon the opening operation of the regulation valve 1264, the first feed gas is provided to the liquefied natural gas production offshore facility 140 through the feed gas supply line 1263. Upon the closing operation of the regulation valve 1264, the supply of the first feed gas to the liquefied natural gas production offshore facility 140 is shut off. The regulation valve 1264 may be provided as an opening/closing valve or a valve capable of regulating the degree of opening. The regulation valve 1264 may be operated by an electrical signal, hydraulic pressure or the like, and may be provided as a valve remotely controllable.

In one embodiment, the gas reinjection device 124 may include a compressor 1241, an injection line 1242, and a valve unit 1243.

For gas reinjection into the reservoir 20, the compressor 1241 may compress the associated gas compressed by the compression device 1261 such that the associated gas has a second target pressure (e.g., 100-2000 bar) higher than the first target pressure of the compression device 1261 to generate an injection gas.

The associated gas (injection gas 50) compressed at a high pressure by the high-power compressor 1241 is reinjected into the reservoir 20 through the injection line 1242.

The valve unit 1243 is installed on the injection line 1242 to regulate the injection of the injection gas 50. The valve unit 1243 may be provided as an opening/closing valve or a valve capable of regulating the degree of opening. The valve unit 1243 is operated by an electrical signal, hydraulic pressure or the like and may be provided as a valve remotely controllable.

The back-flow line 1265 may be branched from the injection line 1242 to be joined to the feed gas supply line 1263. The back-flow gas 52 formed by flowing backward in the reservoir 20 may be recovered to the feed gas supply line 1263 of the crude oil production offshore facility 120 side through the back-flow line 1265. The back-flow line 1265 may be joined to the downstream side of the regulation valve 1264 on the basis of the feeding direction of the feed gas.

The first decompression unit 1266 is installed on the back-flow line 1265 and decompresses the back-flow gas 52 to generate a second feed gas. The first decompression unit 1266 may reduce the pressure (e.g., 100-2000 bar) of the back-flow gas 52 to a pressure (e.g., 30-200 bar) at which the production efficiency of liquefied natural gas may be maximized by the feed gas.

The first decompression unit 1266 may be provided as a valve having not only a decompression function but also an opening/closing function. The first decompression unit 1266 may be provided as, for example, a choke valve. Upon the operation of the first decompression unit 1266, the back-flow gas (second feed gas) decompressed to an appropriate pressure may be provided to the feed gas supply line 1263. Upon the closing operation of the first decompression unit 1266, the second feed gas is not supplied to the feed gas supply line 1263 and is shut off.

The injection gas recovery line 1267 may be branched from the injection line 1242 between the compressor 1241 and the valve unit 1243 of the gas reinjection device 124 to be joined to the feed gas supply line 1263. At least a part of the associated gas (injection gas) compressed by the compressor 1241 may be returned to the feed gas supply line 1263 through the injection recovery line 1267. The injection gas recovery line 1267 may be joined to the downstream side of the regulation valve 1264 on the basis of the feed direction of the feed gas.

The second decompression unit 1268 is installed on the injection recovery line 1267 and decompresses the injection gas to generate a third feed gas. Like the first decompression unit 1266, the second decompression unit 1268 may reduce the pressure (e.g., 100-2000 bar) of the injection gas to a pressure (e.g., 30-200 bar) at which the production efficiency of liquefied natural gas is maximized by the feed gas.

The second decompression unit 1268 may be provided as a valve having not only a decompression function, but also an opening/closing function. The second decompression unit 1268 may be provided as, for example, a choke valve. Upon the operation of the second decompression unit 1268, the injection gas (third feed gas) decompressed to an appropriately pressure may be supplied to the feed gas supply line 1263. Upon the closing operation of the second decompression unit 1268, the third feed gas is not provided to the feed gas supply line 1263 and is shut off.

The feed gas supplied to the liquefied natural gas production offshore facility 140 through the feed gas supply line 1263 may include at least one of the first feed gas compressed by the compression device 1261, the second feed gas decompressed from the back-flow gas 52 by the first decompression unit 1266, and the third feed gas decompressed from the injection gas 50 by the second decompression unit 1268.

The liquefied natural gas production offshore facility 140 is supplied with the feed gas 60 including at least a part of among the associated gas from the crude oil production offshore facility 120 through the feed gas supply line 1263 and processes and liquefies the supplied feed gas to produce the liquefied natural gas.

In the process for processing and liquefying the feed gas in the liquefied natural gas production offshore facility 140, heavy hydrocarbons are removed from the liquefied fluid from the feed gas. Condensate 70 including the heavy hydrocarbons removed from in this process may be transferred to the crude oil production offshore facility 120 through a condensate transfer line 1269, for the processing and stabilization of the heavy hydrocarbons.

The supply of the feed gas to the liquefied natural gas production offshore facility 140 may be controlled by the control unit 128. The control unit 128 may control at least one of the regulation valve 1264, the valve unit 1243, the first decompression unit 1266, and the second decompression unit 1268 to regulate the supply of the feed gas 60.

FIGS. 3 to 6 are block diagrams for describing the operation of an offshore facility according to an embodiment of the present invention. In FIGS. 3 to 6, the valves in the open state are shown in shades, and the valves and lines in the shut-off state are shown in dashed lines.

Figure 3:
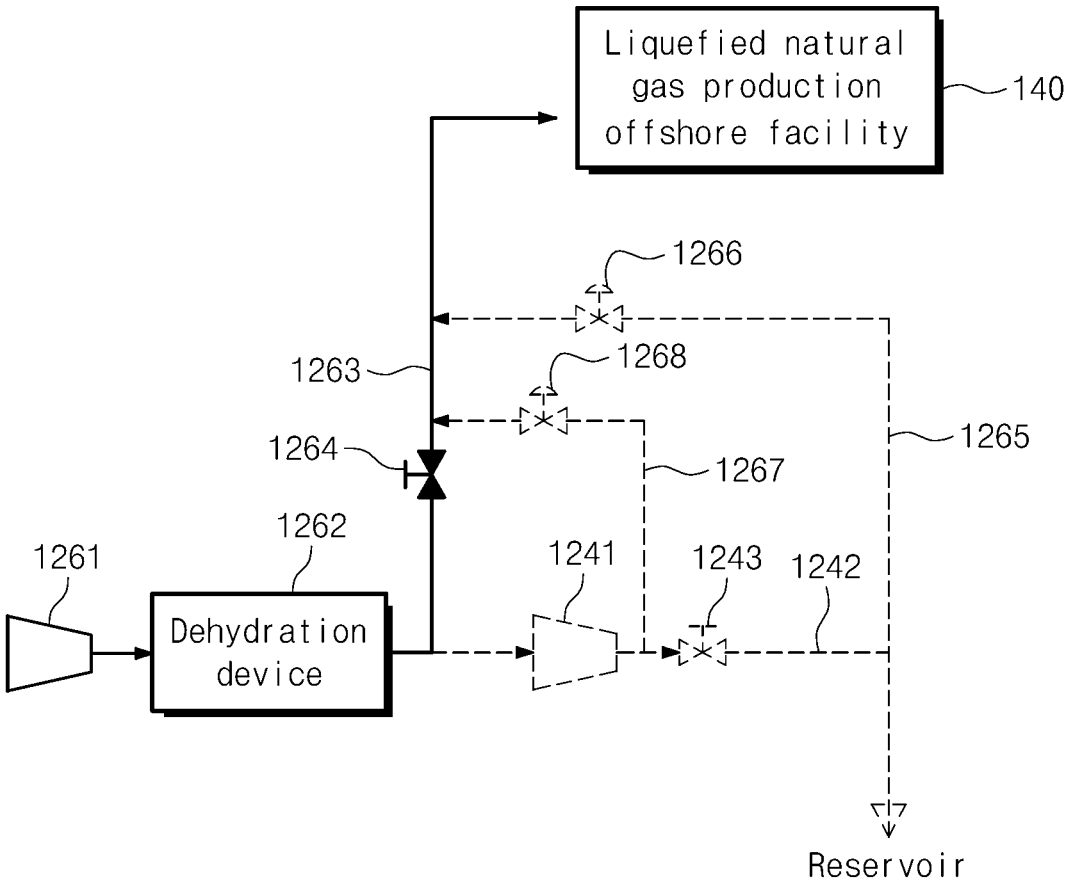
FIGS. 3 to 6 are block diagrams for describing the operation of an offshore facility according to an embodiment of the present invention.

Referring to FIGS. 1 to 3, when the associated gas (first feed gas) compressed by the compression device 1261 is supplied at a normal pressure satisfying a set pressure range (e.g., 70 bar), the control unit 128 may open the regulation valve 1264 and shut off the first decompression unit 1266 and the second decompression unit 1268, as shown in FIG. 3. Accordingly, the associated gas compressed by the compression device 1261 through the feed gas supply line 1263 is supplied to the liquefied natural gas production offshore facility 140, and the liquefied natural gas is produced by processing and liquefaction for the first feed gas.

The pressure of the first feed gas provided by the compression device 1261 may be changed depending on factors such as the composition or pressure of the associated gas separated from the crude oil processing device 122, external environmental factors such as the ambient temperature of the compression device 1261, or the error due to deterioration of the compression device.

Figure 4:
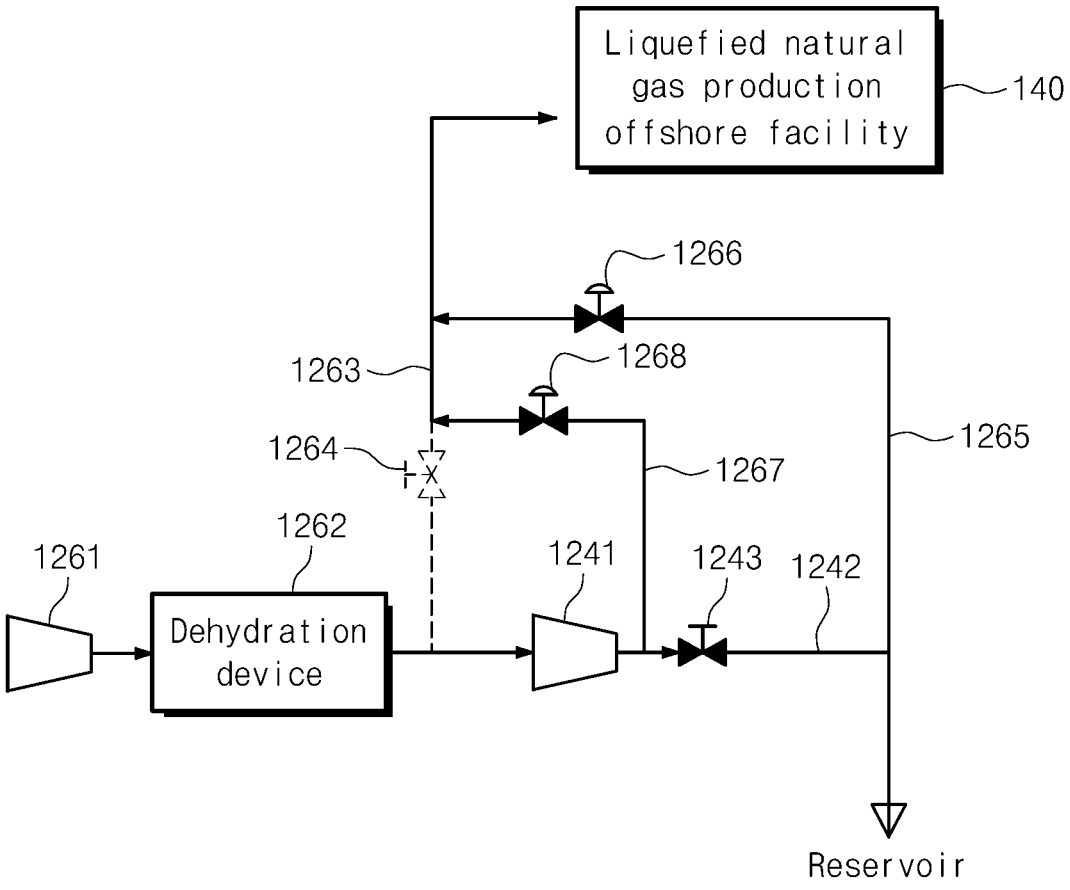

Referring to FIG. 1, FIG. 2 and FIG. 4, due to various factors, when the associated gas (first feed gas) compressed by the compression device 1261 does not satisfy the set pressure range (e.g., 70 bar), for example, when the pressure of the first feed gas is less than 70 bar, the control unit 128, as described in FIG. 4, shuts off the regulation valve 1264, and operates the valve unit 1243, the first decompression unit 1266, and the second decompression unit 1268.

Accordingly, the second feed gas decompressed from the back-flow gas 52 and the third feed gas decompressed from the injection gas 50 are supplied to the liquefied natural gas production offshore facility 140 through the feed gas supply line 1263, and the liquefied natural gas is produced by processing and liquefaction for the second feed gas and the third feed gas.

The control unit 128 may regulate the decompression ratio of the first decompression unit 1266 and/or the second decompression unit 1268 such that the pressure of the feed gas including the second feed gas and the third feed gas supplied through the feed gas supply line 1263 satisfies the set pressure range (e.g., 70 bar).

Even when the pressure of the first feed gas satisfies the set pressure range, in order to simultaneously perform the gas reinjection for maintaining the pressure inside the reservoir and the production of the liquefied natural gas using the feed gas, as in FIG. 4, the control unit 128 may open the regulation valve 1264 and shut off the first decompression unit 1266 and the second decompression unit 1268.

In one embodiment, when it is expected that the pressure inside the reservoir is likely to fall below the standard value, for example, when it is analyzed that the operation of the gas reinjection device 124 is stopped for a long time more than the set time, that the measuring value of the pressure inside the reservoir is lower than the standard value, or the like, even though the pressure of the first feed gas satisfies the set pressure range, the control unit 128 may operate the gas reinjection device 124, shut off the first feed gas, and supply the second feed gas and the third feed gas as the feed gas.

When the internal pressure of the reservoir 20 is excessively low, the injection gas 50 may be mostly reinjected into the reservoir 20, and the back-flow gas 52 may be flowed backward relatively less. When the internal pressure of the reservoir 20 is increased while the associated gas is reinjected into the reservoir 20, the back-flow amount of the back-flow gas 52 may also be increased in proportion to the internal pressure of the reservoir 20.

Therefore, according to an embodiment of the present invention, when the internal pressure of the reservoir 20 is low and the pressure inside the reservoir needs to be maintained, the effect of gas reinjection may be secured above a certain level. Also, when the necessity for maintaining the pressure inside the reservoir is reduced while the internal pressure of the reservoir is gradually increased by gas reinjection, the back-flow gas 52 increased in proportional to the pressure inside the reservoir 20 may be utilized, so that the associated gas more than necessary may be prevented from flowing into the reservoir and being wasted, and the productivity of the liquefied natural gas may be increased by using the back-flow gas 52 flowed backward without reinjecting into the reservoir.

Figure 5:
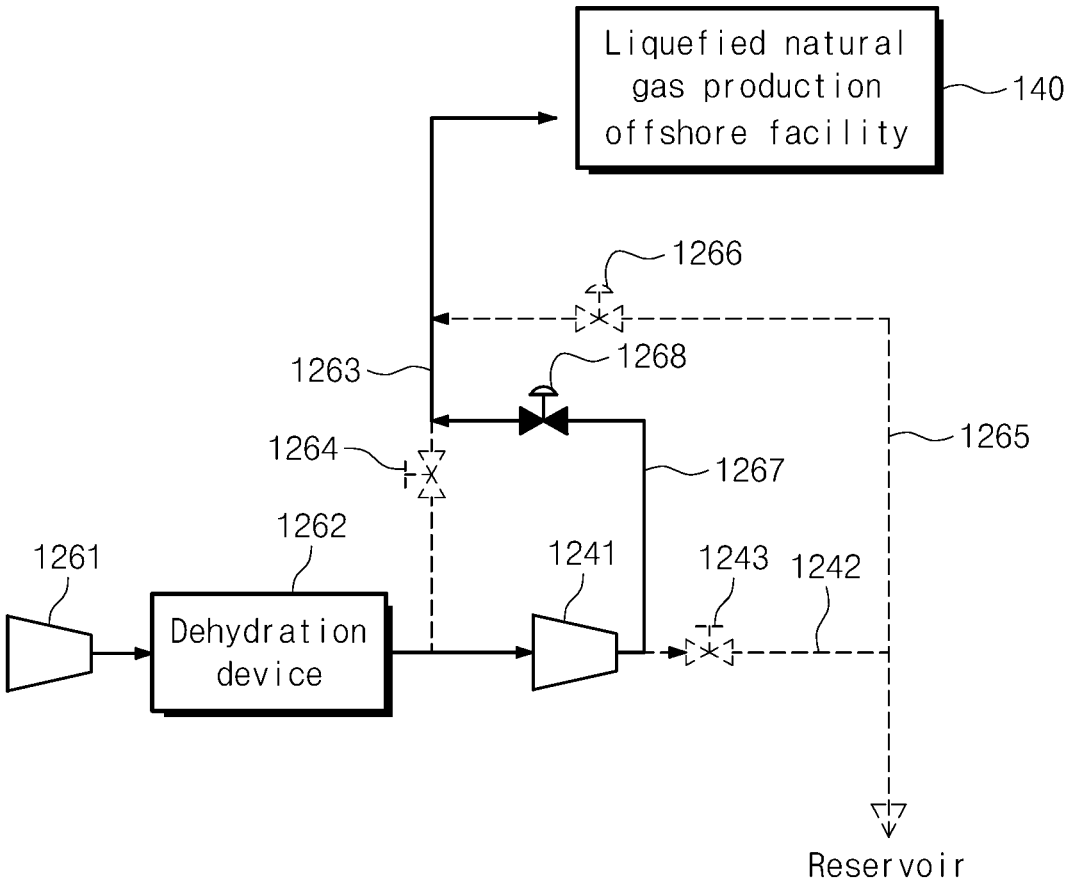

Referring to FIG. 1, FIG. 2 and FIG. 5, when it is determined that the associated gas (first feed gas) compressed by the compression device 1261 is lower than the set pressure, and that the reinjection into the reservoir 20 of the associated gas is not necessary, the control unit 128, as shown in FIG. 5, may shut off the regulation valve 1264, the valve unit 1243 and the first decompression unit 1266, and operate the second decompression unit 1268 to supply the third feed gas to the liquefied natural gas production offshore facility 140 through the feed gas supply line 1263. In this case, the compressor 1241 is not utilized for increasing the pressure of the gas reinjected into the reservoir 20, but as a means for controlling the pressure of the feed gas 60 supplied through the feed gas supply line 1263 to an appropriate level.

In order to supply a mixed gas of the first feed gas compressed by the compression device 1262 and the third feed gas decompressed and formed after compressed by the compressor 1241 as a feed gas to the liquefied natural gas production offshore facility 140, the control unit 128 may additionally open the regulation valve 1264. In this case, the control unit 128 may regulate the degree of opening of the regulation valve 1264 or the decompression level of the decompression unit 1268 such that the pressure of the feed gas including the first feed gas and the third feed gas supplied through the feed gas supply line 1263 satisfies the set pressure range (e.g., 70 bar).

Figure 6:
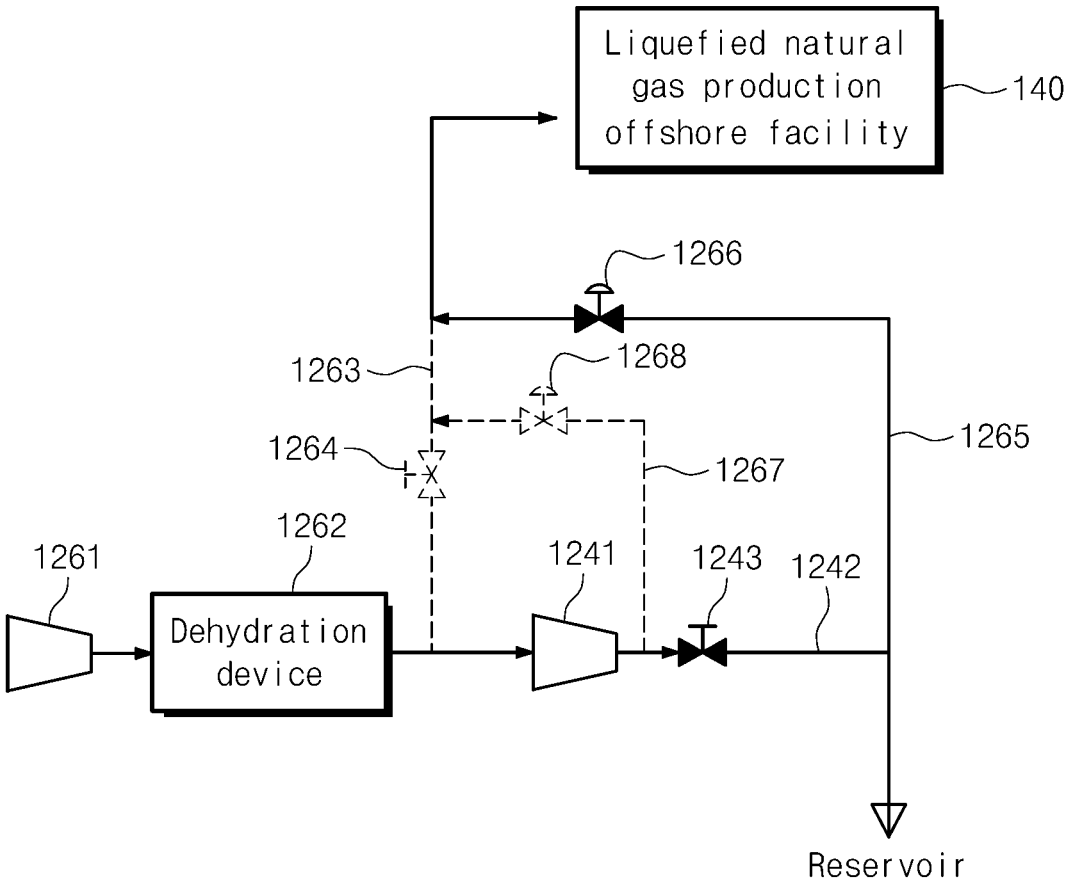

Referring to FIG. 1, FIG. 2 and FIG. 6, when the associated gas (first feed gas) compressed by the compression device 1261 is lower than the set pressure, and the reinjection of the associated gas into the reservoir is necessary, and when an appropriate pressure may be secured by the second feed gas, the control unit 128, as shown in FIG. 6, may shut off the regulation valve 1264 and the first decompression unit 1266 and operate the valve unit 1243 and the first decompression unit 1266 to supply the second feed gas to the liquefied natural gas production offshore facility 140 through the feed gas supply line 1263.

In order to supply the mixed gas of the first feed gas compressed by the compression device 1262 and the second feed gas decompressed after compressed by the compressor 1241 as a feed gas to the liquefied natural gas production offshore facility 140, the control unit 128 may additionally open the regulation valve 1264. In this case, the control unit 128 may regulate the degree of opening of the regulation valve 1264 or the decompression level of the first decompression unit 1266 such that the pressure of the feed gas including the first feed gas and the third feed gas supplied through the feed gas supply line 1263 satisfies the set pressure range (e.g., 70 bar).

As described with reference to FIGS. 3 to 6, according to an embodiment of the present invention, the feed gas may be generated by utilizing the configuration of the gas reinjection device 124 provided for reinjecting by compressing the associated gas, and the liquefied natural gas may be generated using the feed gas, so that depending on the overall situation, the associated gas may utilize the feed gas to gas reinjection or liquefied natural gas production to enhance the usefulness of the associated gas. In addition, various feed gases may be selected and utilized, thereby widening the regulation range of the feed gas pressure, and the pressure control of the feed gas may be performed precisely and effectively, thereby maximizing the production efficiency of the liquefied natural gas. According to an embodiment of the present invention, the liquefied natural gas produced using the associated gas is transferred by a small LNG carrier or the like to utilize for export or for domestic use, so that the economic efficiency may be enhanced.

The crude oil production offshore facility may include a crude oil storage tank, an offloading unit for offloading the crude oil stored in the crude oil storage tank, or the like. The offloading unit may be provided on the side portion of the hull such that the crude oil stored in the crude oil storage tank is supplied to a crude oil carrier or a required place. The offloading unit may include a plurality of loading arms such that the crude oil stored in the crude oil storage tank is supplied to a transport ship or the like.

A mooring device may be provided in the crude oil production offshore facility for mooring the crude oil production offshore facility, the crude oil carrier, or the like. The mooring device may include, but is not limited to, a wire, a drum at which the wire is wound, a driving motor for rotating the drum, and a hook for binding the wire to the hull, and various methods and devices capable of realizing stable mooring of the hull may be applied.

In the above embodiment, the liquefied natural gas has been described as being produced in the liquefied natural gas production offshore facility. However, when the liquefied natural gas generation unit is provided in the crude oil production offshore facility, the feed gas may be transferred to the liquefied natural gas generation unit in the crude oil production offshore facility to produce the liquefied natural gas. In this case, in the crude oil production offshore facility, a LNG storage tank may be additionally provided in addition to the crude oil storage tank.

Figure 7:
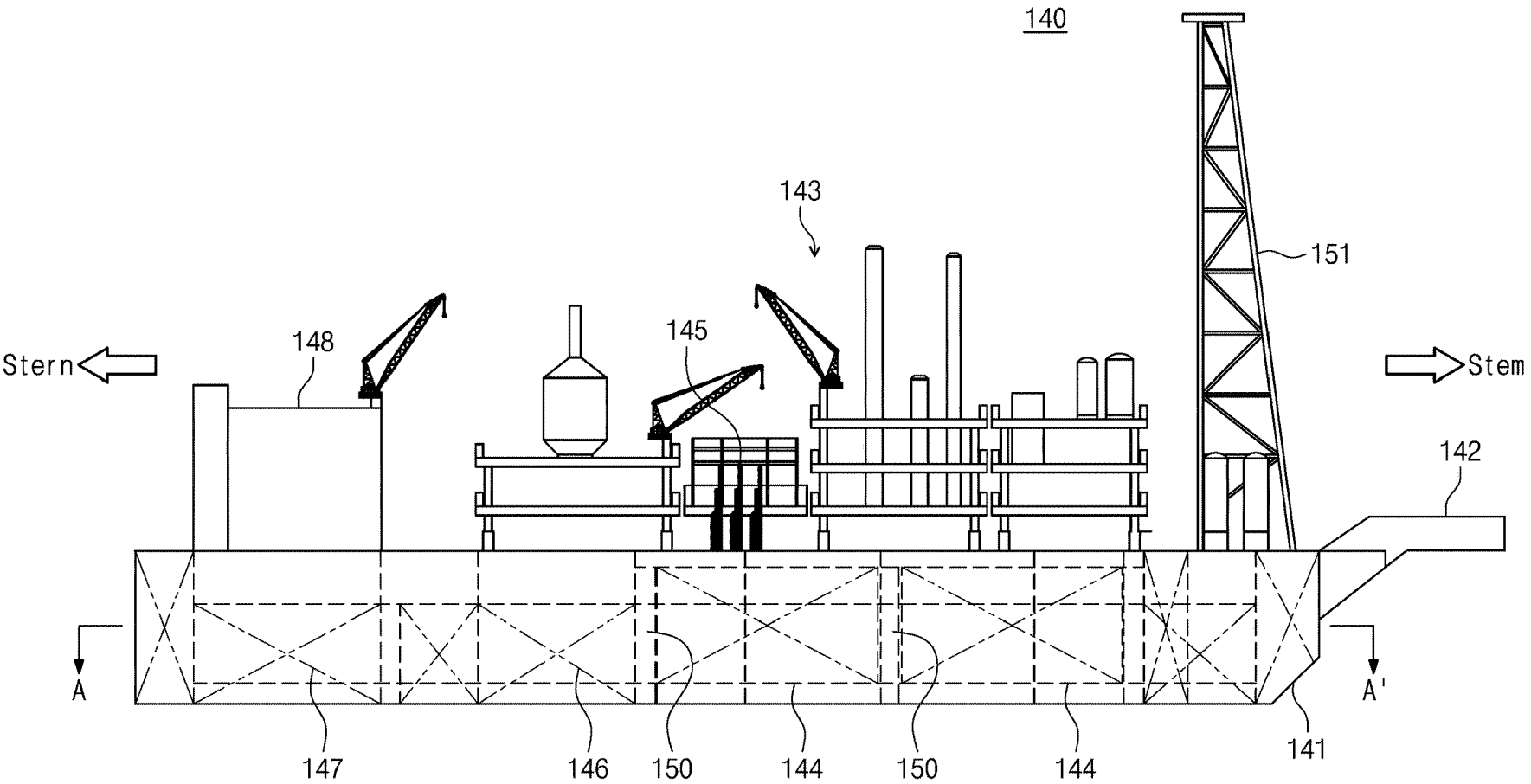
FIG. 7 is a side view of a liquefied natural gas production offshore facility 140 constituting an offshore facility according to an embodiment of the present invention.
Figure 8:
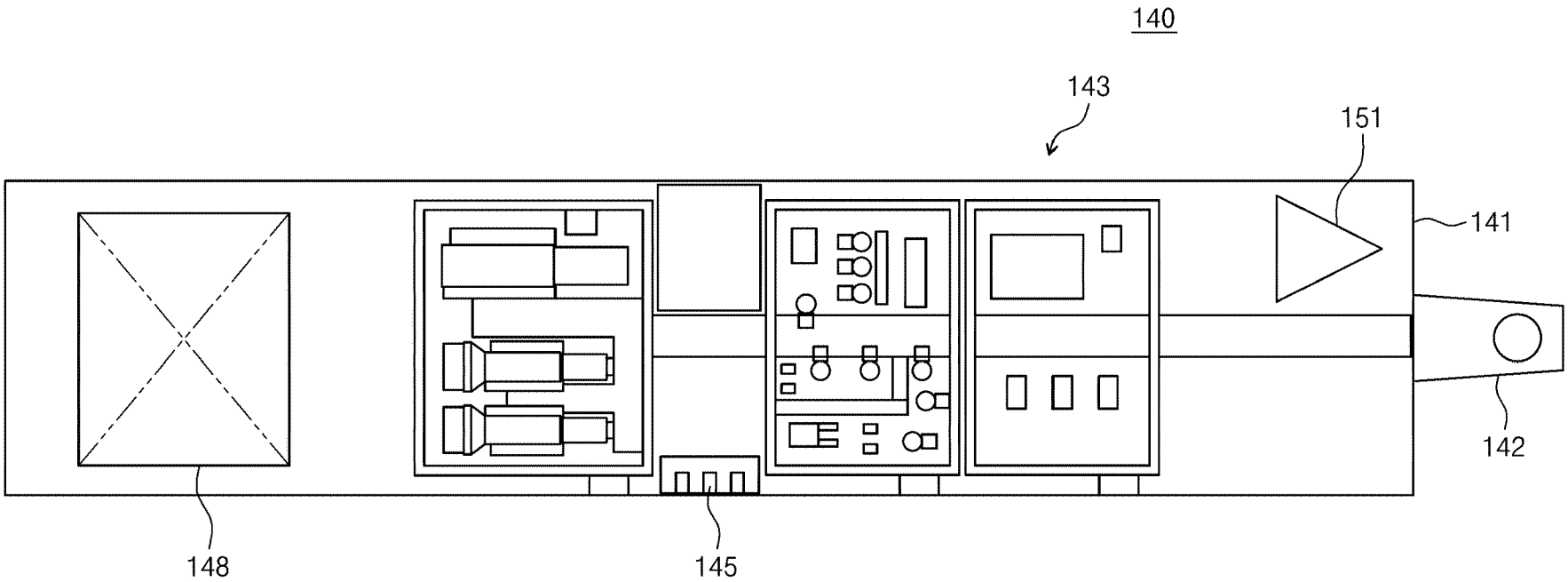
FIG. 8 is a plan view of a liquefied natural gas production offshore facility 140 constituting an offshore facility according to an embodiment of the present invention.
Figure 9:
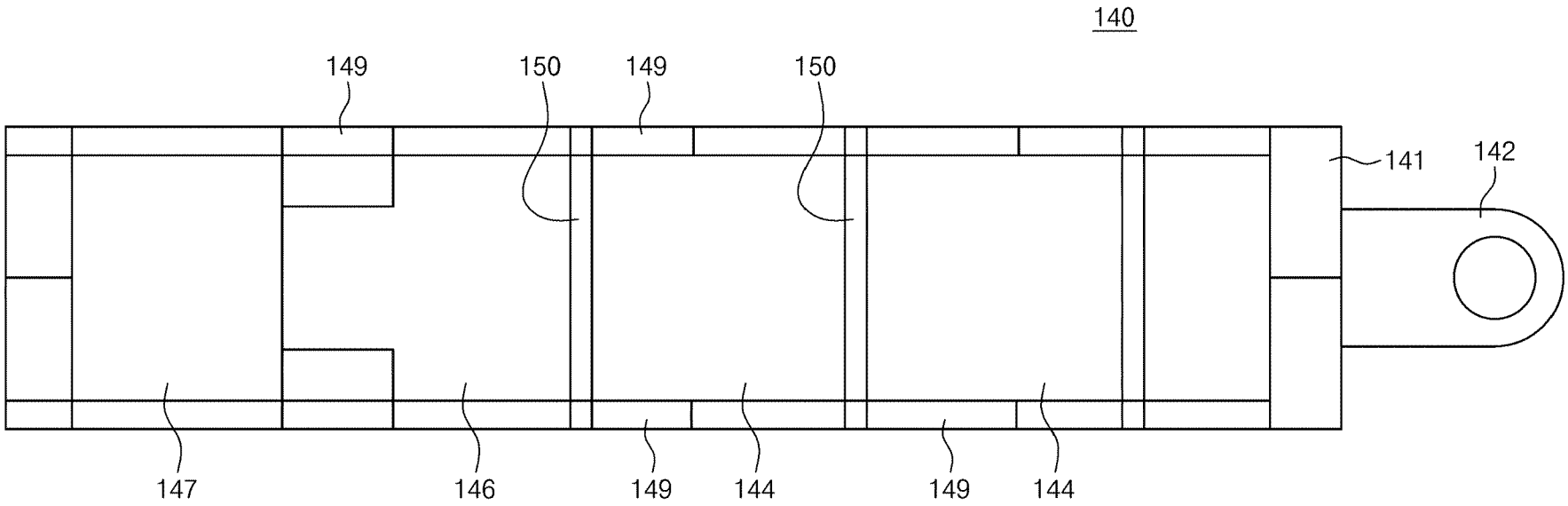
FIG. 9 is a cross-sectional view taken along the line A-A' of FIG. 7.

FIG. 7 is a side view of a liquefied natural gas production offshore facility 140 constituting an offshore facility according to an embodiment of the present invention. FIG. 8 is a plan view of a liquefied natural gas production offshore facility 140 constituting an offshore facility according to an embodiment of the present invention. FIG. 9 is a cross-sectional view along the line A-A' of FIG. 7.

Referring to FIG. 1, and FIGS. 7 to 9, the liquefied natural gas production offshore facility 140 may include a hull 141, a turret unit installed in the hull 142, a liquefied natural gas generation unit 143, a plurality of storage tanks 144, an offloading unit 145, a cooling control unit 146, and the like. In one embodiment, the liquefied natural gas production offshore facility 140 is composed of a minimum number of modules and may be provided as a small offshore facility. The top side module of the liquefied natural gas production offshore facility 140 may be operated so as to have an LNG production capacity of, for example, 0.1-1.0 MTPA (annual average production).

The turret unit 142 may be provided such that the feed gas 60 provided from the crude oil production offshore facility 120 through the feed gas supply line 1263 may be supplied. The turret unit 142 may be operated by being mounted on a vertical opening or a moon pool provided on the bow side of the hull 141.

Figure 10:
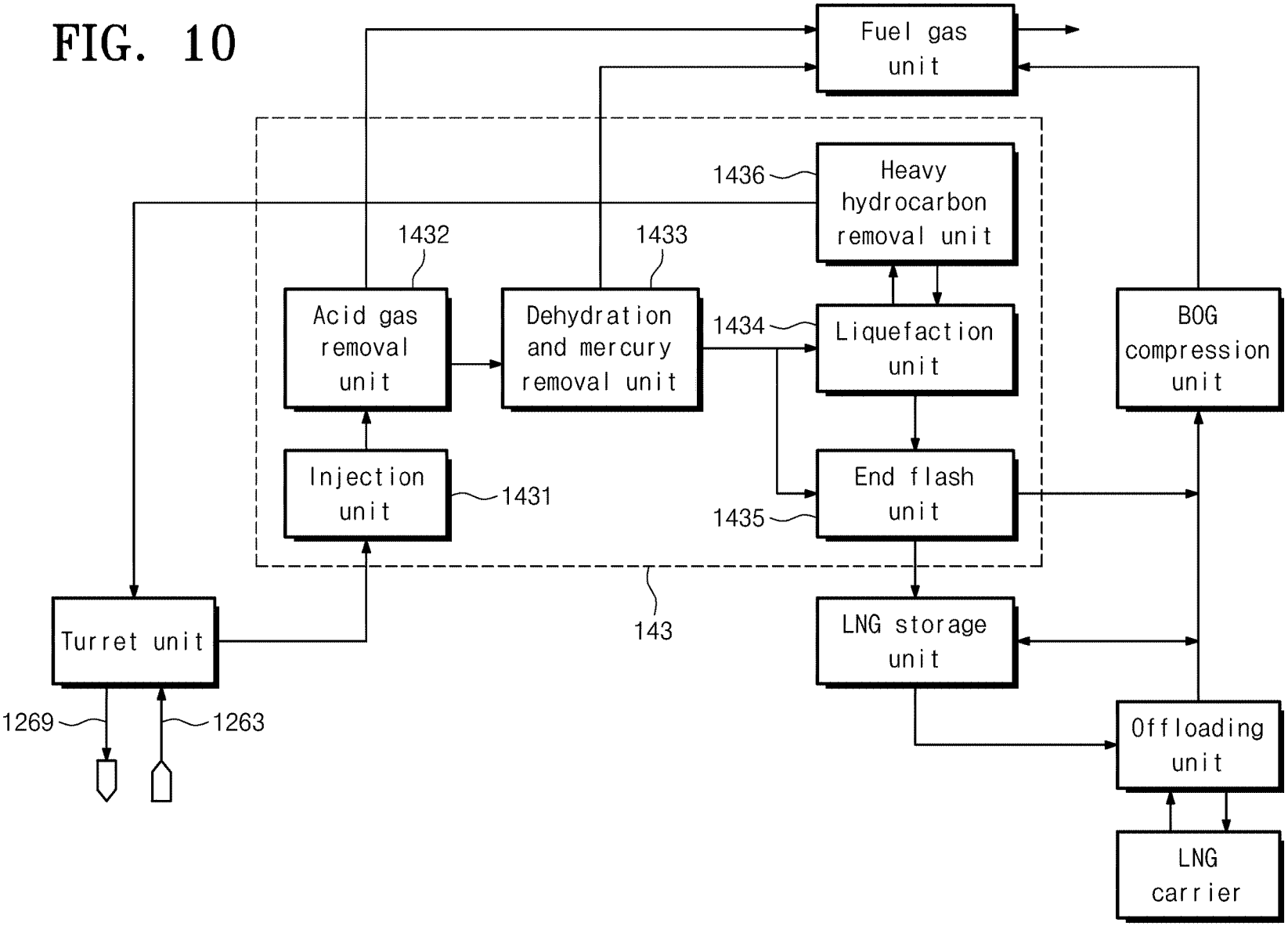
FIG. 10 is a block diagram of a liquefied natural gas generation unit 143 of a liquefied natural gas production offshore facility constituting an offshore facility according to an embodiment of the present invention.

The liquefied natural gas generation unit 143 is processes and liquefies the feed gas supplied from the crude oil production offshore facility 120 to produce the liquefied natural gas. FIG. 10 is a block diagram of a liquefied natural gas generation unit 143 of a liquefied natural gas production offshore facility constituting an offshore facility according to an embodiment of the present invention. Referring to FIG. 10, the liquefied natural gas generation unit 143 may include an injection unit 1431, an acid gas removal unit 1432, a dehydration and mercury removal unit 1433, a liquefaction unit 1434, and a heavy hydrocarbon removal unit 1436.

The injection unit 1431 is supplied with the feed gas supplied through feed gas supply line 1263 from the turret unit 142. In the process of transferring the feed gas to the liquefied natural gas production offshore facility 140 through the feed gas supply line 1263 from the crude oil production offshore facility 120, the feed gas is cooled by the low water temperature on the subsea side, so that the injection unit 1431 may include a heating unit for heating the feed gas to an appropriate temperature necessary for the gas processing.

The acid gas removal unit 1432 removes an acid gas from the heated feed gas provided from the injection unit 1431. The acid gas removal unit 1432 may remove impurities such as carbon dioxide and sulfur contained in the feed gas by an amine adsorption process or the like.

The dehydration and mercury removal unit 1433 removes moisture by regenerative molecular sieve beds or the like in order to prevent freezing of liquid and protect an aluminum facility to be used in the liquefaction unit 1434. The dehydration and mercury removal unit 1433 may remove mercury from the moisture-removed dry gas using a non-regenerative metal sulphide adsorbent bed or the like. The dehydration and mercury removal unit 1433 removes moisture from the feed gas such that it satisfies the $H_2O$ condition of 1 ppmv or less, and mercury is removed to the level of 0.01 microgram/$Sm^3$.

The liquefaction unit 1434 liquefies the feed gas from which moisture and mercury are removed to generate the liquefied natural gas. The liquefaction unit 1434 may include a compressor for compressing the feed gas and a cooler for cooling the evaporation gas heated while passing through the compressor, and the feed gas may be liquefied by heat exchange between the refrigerant supplied by a cooling plant and the pressurized gas. The cooling plant may include a compressor, a condenser, an inflator, and an evaporator, and the refrigerant may be sequentially circulated to each component to generate cryogenic refrigerant.

The heavy hydrocarbon removal unit 1436 removes heavy hydrocarbons from the fluid generated by the liquefaction unit 1434. For processing and stabilization of heavy hydrocarbons, condensates including heavy hydrocarbons may be transferred to the crude oil production offshore facility 140 through the condensate transfer line 1269.

The liquefied natural gas produced by the liquefaction unit 1434 may be supplied to and stored in a plurality of LNG storage units (storage tanks). Referring back to FIGS. 7 to 9, the plurality of storage tanks 144 store the liquefied natural gas, and may be provided in a single row along the longitudinal direction of the hull 141 without a centerline bulkhead from the port side to the starboard. The plurality of storage tanks 144 may be provided in low capacity tanks of approximately 40,000 $m^3$.

Generally, in the case of a large liquefied natural gas production facility, for the structural stability of the top side facility arrangement and the minimization of the sloshing load generated in the sea, a plurality of storage tanks is arranged in a plurality of rows such as two or three rows. However, in the embodiment of the present invention, the top side facility of the liquefied natural gas production offshore facility 140 is provided with specifications of 0.8-1.0 MTPA (annual average production), and the storage tanks 144 may be arranged in one row along the longitudinal direction of the hull 141 for miniaturization and compacting of the hull.

The storage tank 144 may be provided with a heat-insulated membrane-type cargo window such that the evaporation of the liquefied natural gas stored therein due to the external heat penetration may be minimized. As an example, the storage tank 144 may be composed of the Mar III membrane type, but is not limited thereto. In addition, although not illustrated in the drawing, a delivery pump for delivering the liquefied natural gas to the outside may be respectively provided inside the storage tank 144 such that the liquefied natural gas stored therein may be supplied to the required place.

The offloading unit 145 is provided on the side portion of the hull 141 such that the liquefied natural gas stored in the storage tank 144 is supplied to the required place. The offloading unit 145 may be provided with a plurality of loading arms such that the liquefied natural gas stored in the storage tank 144 may be supplied to a LNG carrier or the like. The LNG carrier may be provided as a small vessel, and may transfer LNG to geographically close LNG plants or LNG storage facilities.

Each of the loading arms may include a multi-branch pipe, a flexible pipe or the like in which a plurality of arms is hinge-coupled such that it may combine pipelines having various sizes and shapes. The loading arm may respectively include a fluid line and an evaporation gas line for smooth transfer of the liquefied natural gas, and the inlet side end of the loading arm is connected to the delivery pump inside the storage tank to be supplied with the liquefied natural gas stored in the storage tank 144, and the outlet side end of the loading arm may include a cryogenic connecter such that it may be stably connected to the pipeline of the required place.

Although not illustrated, the mooring device may be provided for mooring the liquefied natural gas production offshore facility, the LNG carrier, or the like. The mooring device may include, but is not limited to, a wire, a drum in which the wire is wound, a driving motor for rotating the drum, a hook for binding the wire to the hull 141, and the like, and may apply various methods and devices capable of realizing stable mooring of the hull 141. Undescribed reference numerals 148, 149, 150, and 151 are a residential area where workers who work aboard the liquefied natural gas production offshore facility reside, a ballast tank filled with ballast water, a cofferdam formed on the side portion of the storage tank 144, and a flare tower for combusting the waste gas generated in gas processing and liquefaction process.

While the present invention has been described in connection with certain exemplary embodiments, it is to be understood that the invention is not limited to the disclosed embodiments, but, on the contrary, is intended to cover various modifications and equivalent arrangements included within the spirit and scope of the invention. The technical scope of the present invention should be determined by the technical idea of the claims, and it should be understood that the technical scope of the present invention is not limited to the literal description of the claims, but actually extends to the category of equivalents of technical value.

The invention claimed is:

1. An offshore facility comprising:

a crude oil production offshore facility having a crude oil processor for refining crude oil collected from a subsea well to produce oil;

a feed gas supplier including a first compressor for compressing an associated gas separated in the process of refining the crude oil for generating a first feed gas such that the associated gas has a first target pressure; and a gas injector including a second compressor for generating an injection gas by compressing the associated gas compressed by the first compressor such that the compressed associated gas has a second target pressure higher than the first target pressure, and an injection line for reinjecting the injection gas into a reservoir;

a liquefied natural gas production offshore facility supplied with a feed gas from the feed gas supplier including at least a part of the associated gas from the crude oil production offshore facility, and processing and liquefying the feed gas to generate a liquefied natural gas, wherein the feed gas supplier includes:

a feed gas supply line for transferring the feed gas to the liquefied natural gas production offshore facility;

a back-flow line branched from the injection line and joined to a feed gas supply line for recovering a back-flow gas which flows backward from the reservoir and includes at least a portion of the injection gas reinjected to the reservoir by the gas injector; and a first decompressor for decompressing the back-flow gas to generate a second feed gas, and wherein the feed gas comprises at least one of the first feed gas, the second feed gas, a third feed gas, and combinations thereof, decompressed from the injection gas.

2. The offshore facility of claim 1, wherein the first decompressor comprises a choke valve installed on the back-flow line.

3. The offshore facility of claim 1, wherein the gas injector further comprises a valve installed on the injection line and regulating injection of the injection gas, and wherein the feed gas supplier further comprises:

an injection gas recovery line branched from the injection line between the compressor and the valve and jointed to the feed gas supply line; and a second decompressor installed on the injection gas recovery line and decompressing the injection gas to generate the third feed gas.

4. The offshore facility of claim 3, wherein the feed gas supplier further comprises a regulation valve installed on the feed gas supply line and regulating supply of the first feed gas, and the back-flow line and the injection gas recovery line are respectively joined to a downstream side of the regulation valve on the basis of a feeding direction of the feed gas.

5. The offshore facility of claim 4, wherein the crude oil production offshore facility further comprises a controller controlling at least one of the regulation valve, the valve, the first decompressor, the second decompressor, or combinations thereof.

6. The offshore facility of claim 5, wherein when a pressure of the first feed gas satisfies a set pressure range, the controller performs control such that the regulation valve is opened and the first feed gas is supplied to the liquefied natural gas production offshore facility, and supplies of the second feed gas and the third feed gas are shut off, and when the pressure of the first feed gas does not satisfy the set pressure range, the controller performs control such that at least one of the first decompressor and the second decompressor are operated to supply at least one of the second feed gas and the third feed gas to the liquefied natural gas production offshore facility, and the regulation valve is shut off.

7. The offshore facility of claim 1, wherein the liquefied natural gas production offshore facility comprises:

a turret supplied with the feed gas;

a liquefied natural gas generator for processing and liquefying the feed gas to generate the liquefied natural gas; and a plurality of storage tanks provided in one row along a longitudinal direction of a hull and storing the liquefied natural gas.

8. The offshore facility of claim 7, wherein the liquefied natural gas generator comprises:

an injector including a heater for heating the feed gas to a set temperature;

an acid gas remover for removing an acid gas from the heated feed gas provided from the injector;

a dehydration and mercury remover for removing moisture and mercury from the feed gas from which the acid gas has been removed; and a liquefier for generating the liquefied natural gas by liquefying the feed gas from which the moisture and the mercury are removed, and wherein the liquefied natural gas production offshore facility further comprises:

a heavy hydrocarbon remover for removing heavy hydrocarbons from fluid generated by the liquefier; and a condensate transfer line for transferring condensate including the heavy hydrocarbons for the processing and stabilization of the heavy hydrocarbons to the crude oil production offshore facility.

* * * * *